US006254461B1

(12) United States Patent
Benning et al.

(10) Patent No.: US 6,254,461 B1
(45) Date of Patent: Jul. 3, 2001

(54) PROCESS OF DRESSING GLASS DISK POLISHING PADS USING DIAMOND-COATED DRESSING DISKS

(75) Inventors: Frederick P. Benning; Dennis L. Fox; James A Hagan; Kerry R. Lindemann, all of Rochester; Donald L. Mabe, Chatfield, all of MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/526,404

(22) Filed: Mar. 15, 2000

(51) Int. Cl.[7] ..... B24B 29/00
(52) U.S. Cl. ..... 451/56; 451/443
(58) Field of Search ..... 451/56, 443, 41, 451/285, 287, 288

(56) References Cited

U.S. PATENT DOCUMENTS 5,626,509 * 5/1997 Hayashi ..... 451/56
5,779,521 * 7/1998 Muroyama et al. ..... 451/56
5,954,570 * 9/1999 Yano et al. ..... 451/285
6,004,193 * 12/1999 Nagahara et al. ..... 451/443

* cited by examiner

*Primary Examiner*—Eileen P. Morgan
(74) *Attorney, Agent, or Firm*—Laurence R. Letson

(57) ABSTRACT

A dressing disk for dressing and reconditioning the polishing pad of a planetary disk polishing machine is fabricated by plating a nickel/diamond matrix layer onto a stainless steel disk wherein the matrix layer thickness is developed or plated to a thickness which leaves exposed about 25 percent of the fine diamond particles, thereby forming a surface that has the look and feel of medium to coarse sandpaper. The dressing disks are inserted into the holes in a disk carrier of a planetary polishing machine and driven by its central rotary drive. While being so driven under a flow of water to carry away abraded particles, a pair of polishing pads are engaged with the disk surfaces and forced together with a loading or down force to cause the disks to abrade or grind away a thin surface layer of the polishing pad, thereby removing glazing and exposing cerium particles embedded in the urethane matrix of the polishing pad to engage the glass disks to be polished to a very smooth surface for use as substrates for magnetic memory disks useable in disk drives.

6 Claims, 3 Drawing Sheets

PROCESS OF DRESSING GLASS DISK POLISHING PADS USING DIAMOND-COATED DRESSING DISKS

FIELD OF THE INVENTION

This invention relates to utilizing diamond matrix-coated dressing disks to dress the surfaces of polishing pads of a glass disk polishing machine and, more specifically, a process to dress these polishing pads of a glass disk polishing machine.

BACKGROUND OF THE INVENTION

In the manufacture of magnetic disk drive data storage devices, the magnetic disk drives incorporate one or more magnetic data storage disks. Each magnetic data storage disk typically is made of a thin flat glass disk with its planar surfaces closely controlled to be flat and parallel to each other. The surfaces of the data storage disks are coated with a layer of magnetically alterable material which will accept and maintain different magnetic orientations within very small domains. The magnetic data storage disks are incorporated into and rotated at a very high speed by the magnetic disk drive. The magnetic disk drive also incorporates at least one magnetic read/write head positionable adjacent the data recording surface. As the data recording disk rotates, the air flow proximate the data recording surface of the disk causes the read/write head to "fly" or levitate a very small distance above the magnetic data storage disk surface. The read/write head does not make contact with the recording surface during normal operations due to the flow of the air between the disk surface and the read/write head. The closer the read/write head can fly to the surface of the data disk without impacting or contacting the surface at the disk, the more densely the data may be recorded, thereby both increasing the data storage capacity of the magnetic storage disks and shortening the requisite read/write cycles to either retrieve or record the data.

In order to accommodate a very close read/write head flight height, it is necessary to present a very flat and very smooth data disk surface to the read/write head. The basis for a flat and smooth recording surface is a very flat and very smooth substrate surface. A flat and smooth surface of a glass disk substrate is created by polishing flat surfaces on a glass disk with polishing pads, typically hard pads of urethane incorporating therein particles of cerium. Cerium is a soft malleable metal which lends itself to high quality polishing. The cerium provides the abrasive needed both to accomplish the removal of the minute quantities of glass if used with a polishing fluid to produce the required, very smooth surface on the glass disk. A liquid containing a fine suspension of cerium particles is flooded between the surfaces being polished and a polishing pad to further abrade the glass disk surface and to carry away the minute glass particles removed during polishing from the glass disks. During the polishing of the disks, a conventional and well-known process, the urethane/cerium polishing pads become glazed with glass residue of the polishing process and small cerium particles that are eroded from the polishing pad. Any degradation of the surface of the polishing pads reduces the polishing efficiency of the polishing operation.

The cerium loaded urethane polishing pads are available fro Universal Photonics, Hicksville, N.Y. 11801. The preferred polishing pads are designated L66 Cerium Loaded Urethane Pads.

Therefore, dressing the polishing pads of a polishing machine is a normal but very time consuming maintenance requirement in a high quality polishing process to achieve the desired, high quality, polished surfaces. In order to renew the polishing surfaces of the polishing pad and remove the glazing and other debris from the surface of the polishing pad, a small portion of the surface of the polishing pad must be removed, abrading or cutting off and rendering exposed new surfaces of the cerium particles trapped in the urethane pad. The newly exposed surfaces of the cerium particles incorporated in the urethane matrix are abraded to a smooth surface.

Refer now to FIGS. 1, 2 and 3. Apparatus of the prior art as illustrated in FIG. 1 is a schematic of a portion of a conventional planetary polishing machine 10, as viewed from the top. Central rotary drive 12 is provided with a gear-shaped outer circumference 15 forming, in effect, a driven sun gear 14. Central rotary drive 12 is engaged by the outwardly projecting gear teeth 30 on the periphery of driven planetary ring 16. Planetary ring 16 is positioned intermediate the central rotary drive 12 and fixed interior ring gear 18, which is either formed into or positioned within the interior of tub 20. The tub 20 remains stationary; with gear teeth 30 on planetary ring 16 engaged with interior gear 18, the central rotary drive 12 rotates planetary ring 16, and thus, planetary ring 16 will be driven around the interior ring gear 18 within tub 20. Tub 20 supports a polishing pad 22 for polishing glass substrate disks (not shown) from which magnetic data storage disks are made.

The dressing rings 16 are annular rings 16 of a high strength metal such as steel or stainless steel, which support on each of their annular surfaces 26 a plurality of pellets 24, typically thirty to forty. These pellets 24, approximately 0.25 inches (6.4 mm) in height, 0.75 inch (19.1 mm) in diameter, are a matrix of material binding diamond particles 36. The pellets 24 are formed by sintering a hot isostatically pressed body of a mixture of nickel particles and diamond particles 36. The pellets 24 are bonded onto the metal ring 16. The metal rings 16 are provided with gear teeth 30 cut into the outer periphery 32 to mesh with the gear-shaped outer circumference 15 of central rotary drive 12. Dressing rings of the type described above may be secured from Mitsui Mining and Smelting Co., Osaka, Japan.

The planetary rings 16 are employed in sets; a plurality, preferably five, are used at one time in the polishing machine 10. Prior to the use of the dressing rings 16 in a dressing operation as well as at repeated intervals during the life of the dressing rings 16, the faces 34 of the pellets 24 are ground not only to be flat but also to be a uniform height above the ring surface 17. The surfaces 34 of the pellets 24 on opposite sides of rings 16 also must be ground completely parallel to each other to prevent one leading edge 28 of a pellet 24 from gouging the polishing pad 22.

The dressing of the polishing pads 22 is accomplished by lowering a similar polishing pad (not shown) onto the dressing rings 16 and particularly onto faces 34 of pellets 24 and rotating the central rotary drive 12. Because the pellets 24 move over the polishing pad 22, the sharp corners or leading edge 28 of the pellets 24 and the exposed edges of diamonds 36 cut and remove thin layers of urethane and cerium from the polishing pad 22, the smooth flat faces of the diamond particles smooth the surface of polishing pad 22. A fluid is flowed over the polishing pad 22 and dressing rings 16 to flush away dressed particles removed from the polishing pads 22. The fluid typically is water provided in a large enough flow to accomplish the desired flushing function.

To avoid damaging polishing pads 22 by concentrating excessive force on the interface between the polishing pad 22 and the nickel/diamond matrix pellets 24, polishing machine 10 is operated at a reduced speed and with only a moderate force exerted on the polishing pads 22 and on each dressing ring 16 by pellets 24.

The polishing machine 10 is operated in the dressing operation for a period of an hour or more, which is non-productive down time.

OBJECTS OF THE INVENTION

It is an object of the invention to rapidly but accurately remove glazing, abrasive and matrix material from polishing surfaces of polishing pads of a planetary polishing machine.

It is another object of the invention to improve the utility of the polishing machine.

It is still another object of the invention to eliminate the need for maintaining precise flatness on the dressing face of diamond matrix pellets bonded onto dressing rings.

It is a further object of the invention to reduce the number of dressing tools needed to dress polishing machine polishing pads for a plurality of polishing machines.

It is a still further object of the invention to eliminate the need to provide each individual dressing tool with a specialized drive configuration compatible with only a single rotary polishing machine.

It is an additional object of the invention to reduce the cost of dressing tools for planetary polishing machines.

SUMMARY OF THE INVENTION

In order both to rapidly and efficiently dress cerium-loaded urethane polishing disks utilized for glass disk polishing and to remove glaze and surface loading of glass particles on the surface of such polishing disks, a planetary polishing machine is loaded with a dressing disk carrier holding a plurality of dressing disks. Such a planetary disk polishing machine may be purchased from Peter Wolter of Rendsburg, Germany.

A dressing disk carrier is a stainless steel plate having a plurality of holes to accept dressing disks therein. The circular plate has a gear profile cut into the outer edge of the carrier. The gear profile on the dressing disk carrier edge meshes with the central rotary drive and with the interior ring gear in the tub of the polishing machine.

Dressing disks are flat, circular plates which have been plated with a nickel layer from a nickel solution having therein a suspension of very fine diamond particles. As the nickel is plated onto the disk substrate, the diamond particles from the suspension are captured in the nickel layer thereby resulting in a matrix of nickel and diamond particles on the disk substrate surface. The plating is continued until the nickel matrix layer is deposited leaving exposed about 25 percent of the diamond particle; typically, a layer of nickel is 30 to 40 microns (<0.002 inches) in thickness. The diamond particles preferably are approximately 74 microns (<0.003 inches) across.

The result following the nickel plating is a disk with abrasive surfaces which closely resemble the roughness and feel of a medium to coarse sandpaper.

Alternatively, the center of the disks surfaces may be masked and left unplated to prevent a single diamond particle from possibly forming a score line in a cycloid path.

The dressing disk may be provided with a small central hole for ease in handling. The resulting disk is placed in a disk carrier of a planetary polishing machine and the disk carrier driven in a rotary and circular motion about a center drive gear. The dressing disk carrier is fashioned to carry a plurality of these abrasive disks; moreover, a plurality of the carriers may be used simultaneously to improve the quality of the dressing operation as well as to shorten the dressing time. The dressing disks are forced onto the polishing pad, forcibly engaging the abrasive surfaces of the dressing disks with the polishing pad, while the dressing disks are moved relative to the polishing pad. Both sides of the dressing disk can be engaged with polishing pads, thereby simultaneously dressing both a top and a bottom polishing pad. During the dressing operation, a flow of water or other suitable liquid is caused to flow over and between the polishing pads both to carry away and flush out the dressing debris as well as to prevent the debris from later either damaging the polished glass disks or preventing a proper smoothing of the polishing pads.

The typical planetary polishing machine may utilize from 3 to 5 disk carriers and 18 to 30 dressing disks. The dressing disks may be used in various polishing machines so long as the disk carriers used with those different machines have "disk accepting" holes of a diameter to accommodate the dressing disks.

A more complete and detailed understanding of the invention may be had from the drawings and the detailed description of the invention that follow.

DETAILED DESCRIPTION OF THE PREFERRED

EMBODIMENT OF THE BEST MODE OF THE INVENTION AS CONTEMPLATED BY THE INVENTORS

Figure 4:
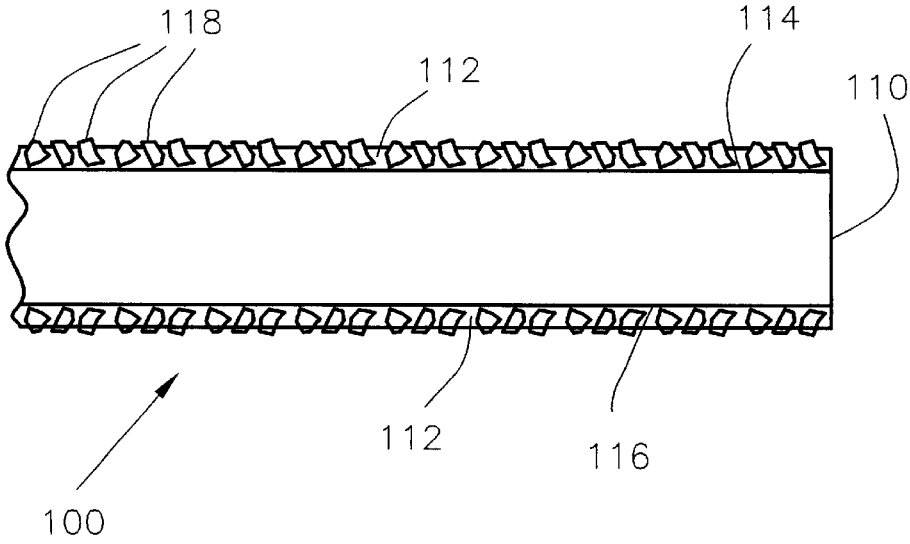
FIG. 4 is a partial-edge view of a dressing disk of the invention.
Figure 5:
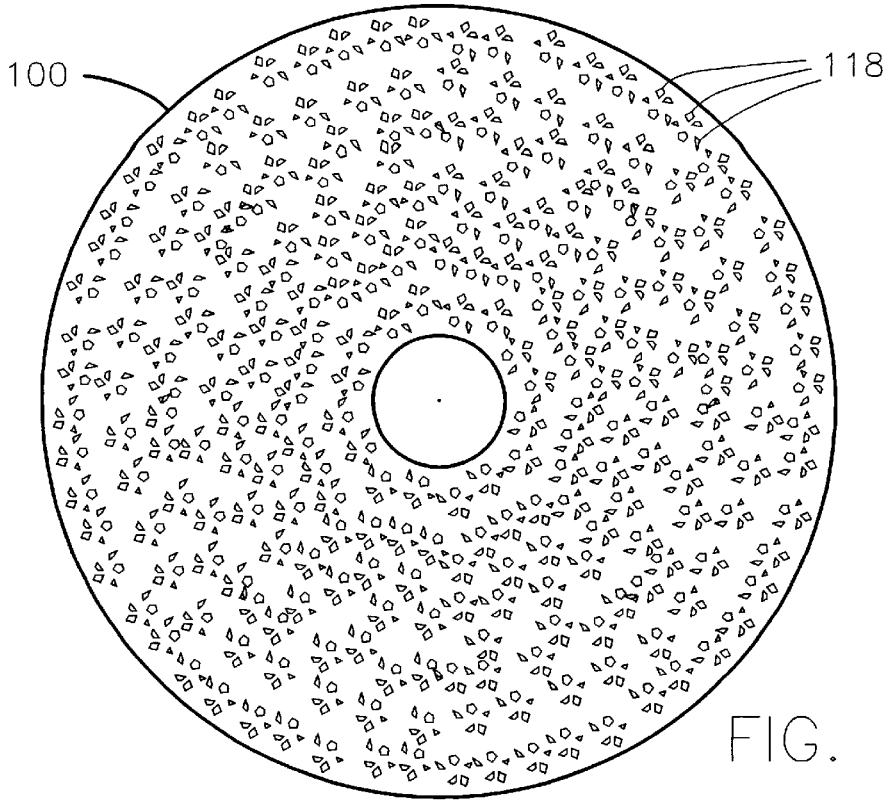
FIG. 5 is a top view of the dressing disk of the invention.
Figure 6:
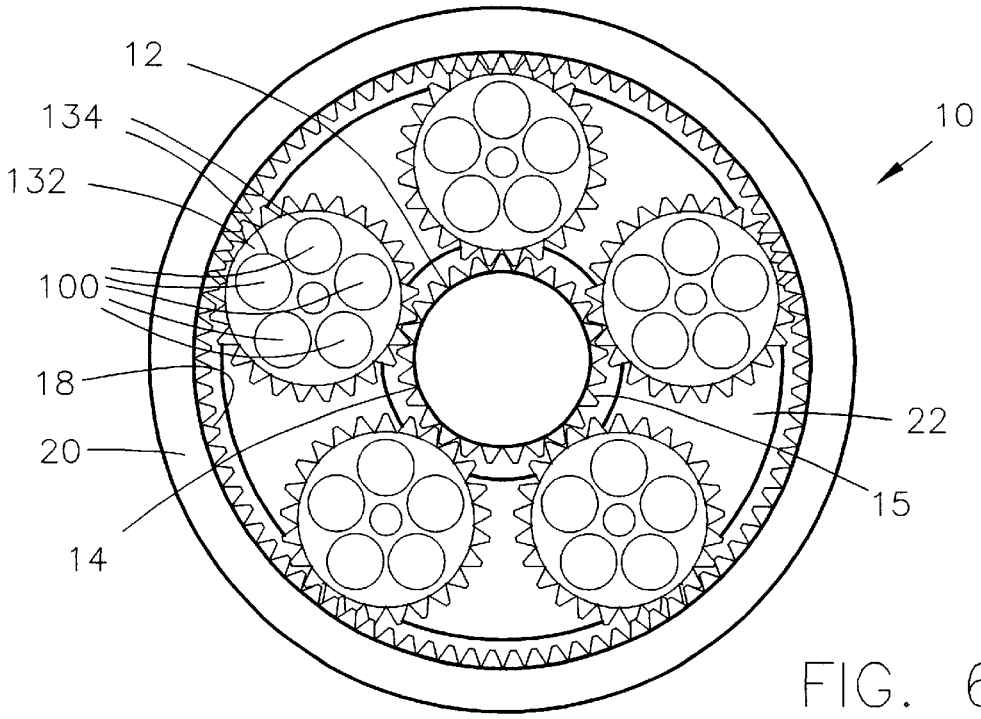
FIG. 6 is a diagrammatic representation of the drive of a conventional polishing machine with a set of disk carriers and dressing disks insalled.

The invention is best described with initial reference to FIG. 4.

A stainless steel disk 110, a portion of which is illustrated in FIG. 4, is provided with very thin layers 112 of binding metal on both top and bottom surfaces 114, 116, respectively. The binding metal layer 112, typically nickel, is plated onto disk surfaces 114, 116. Metal binding layers 112 additionally incorporate a large number of industrial grade diamond particles 118 of a substantially uniform size.

Using a suitable conventional plating process, binding metal layer 112 is plated from a nickel plating solution which further includes a diamond suspension. During the plating process, such as occurs in electroplating, as the nickel is deposited from the plating solution onto the stainless steel substrate 110, the diamond particles 118 are trapped in and partially encased by the plated nickel layer 112 forming a matrix with any gaps, holes or openings therein containing and holding the diamond particles 118.

The diamond particles 118 preferably measure approximately 74 microns (less than 0.003 inches) across. The 30 to 40 micron layer of plated nickel 112 will cover a large portion of the surface of each diamond particle 118; thus, all the diamond particles 118 which are in contact with or very close to the stainless steel substrate 110 will extend to substantially the same height above the stainless steel dressing disk substrate 110, producing an abrasive surface texture of the nickel-plated matrix 112 and diamond particles 118. The nickel/diamond matrix forms a roughened abrasive surface on all or most of the circular surfaces 114, 116, of dressing disk substrate 110. The exposed portions of diamond particles 118 form hard abrasive projections above the nickel matrix 112 on the disk 100.

The dressing disk 100 preferably has a diameter the same as or slightly larger than the glass disks to be polished. The larger size dressing disks 100 insure that any surface area of the urethane polishing pads 22 contacting the memory disk substrate will not have regions left undressed by the dressing disk 100. The disk carrier 132 is used with the dressing disks 100 for dressing the polishing pads 22 are such that the dressing disks 100 are positioned therein to extend outdie the outer diameter and inside the inner diameter of the polishing pads 22 at some point in their travel paths to insure that no rim is formed and left on the polishing pads 22.

To fully utilize the dressing disks 100 to dress the urethane polishing pads 22 of the polishing machine 10, a plurality of dressing disks 100 are loaded into a plurality of dressing disk carriers 132 and rest against the illustrated polishing pad 22. Polishing pad 22 is held stationary relative to the polishing machine 10. The top-positioned polishing pad (not shown but similar to polishing pad 22) is held stationary after being lowered into contact with the top surface 114 of the dressing disk 100, and the polishing machine 10 is operated in a conventional manner.

Additionally, it may be found advantageous to operate the polishing machine 10 at a slower speed and with a larger down force on the top polishing pad (not shown). The dressing down force is larger than the polishing down force employed during disk polishing operations, thereby foreshortening the polishing pad dressing operation. A slower speed prevents damage to the polishing pad 22 during the period of large down forces being exerted on the polishing pads 22 and dressing disks 100, but is offset by the much larger engaging surfaces of the dressing disks 100 and the larger down forces employed. The down forces used during dressing are sufficient to create a pressure of between 0.5 and 3.0 psi at the interface of the dressing disk 100 and the polishing pad 22.

The disk carrier 132 and dressing disks 100 are rotated and driven around the axis of the polishing pad 22. Each of the protruding diamonds 118 act to cut, abrade and remove minute amounts of the cerium bonded in the urethane polishing pad 22 along with a minute thickness of the urethane polishing pad 22, thereby both exposing a new surface portion of the polishing pad 22 with its cerium particles and smoothing the surface of the polishing pad 22. The dressing process not only removes any loading of glass residue but also any glazing on the polishing surface of pad 22.

Once dressed, the polishing pads 22 are returned to polishing use. The dressing disks 100 and the dressing disk carriers 132 are replaced in the polishing machine 10 with carriers 134 for the glass substrate disks and glass disks positioned within the openings in the carriers 134. The top polishing pad (not shown) is closed onto the carrier 134 and glass disks (not shown), the polishing fluid flow resumed, down force applied and the disks and carriers 134 driven in their planetary paths, as is conventional. The fluid used to polish the glass disks is a suspension of very fine cerium particles carried in water or other suitable liquid.

The number of dressing disks, the number of disks carriers, and the down force applied may be selected and varied to control the amount of polishing pad material removed and/or the time required for the dressing operation. The more dressing disks used, the higher the down force required; the higher the down force, the faster the dressing cycle may be completed. The speed of the planetary polishing machine typically is reduced during a dressing operation and operated at approximately 50 percent of its normal polishing speed for glass disks. This reduced speed of operation helps prevent undue polishing pad material removal and/or any possible damage to the polishing pads 22.

Because the dressing disks 100 provide much larger surface areas for engaging the polishing pad 22, the disks 100 are much more efficient than the prior art dressing rings with diamond matrix pellets. Also, the use of dressing disks 100 permits the use of a much higher or larger down force without damaging the urethane/cerium polishing pads 22.

Figure 1:
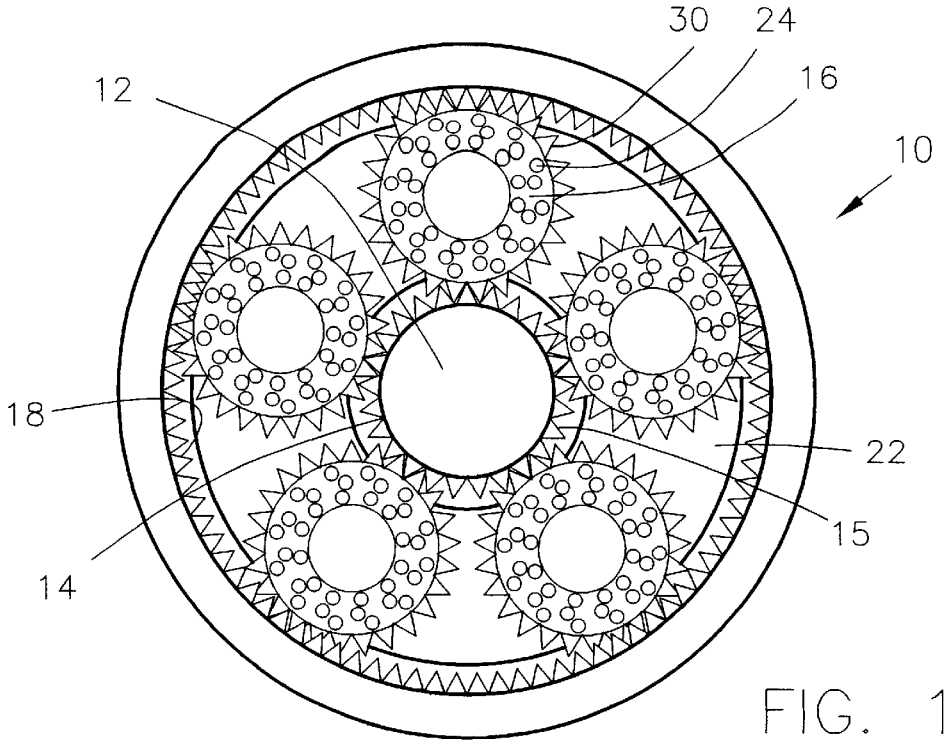
FIG. 1 PRIOR ART
FIG. 1 is a diagramatic representation of a drive of a conventional disk polishing machine with a set of dressing rings installed.
Figure 2:
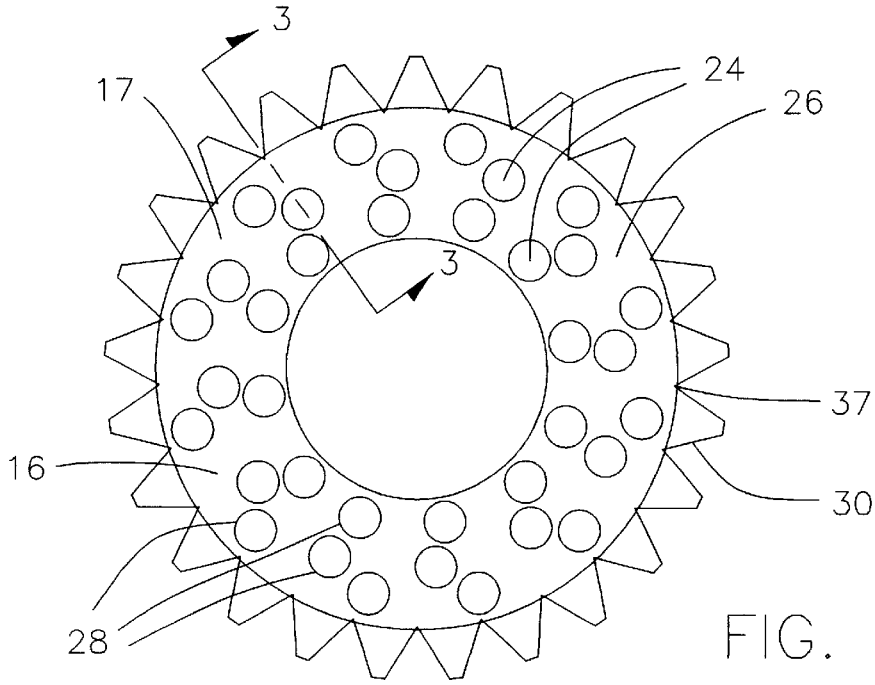
FIG. 2 PRIOR ART
FIG. 2 illustrates a top view of a conventional polishing machine dressing ring.
Figure 3:
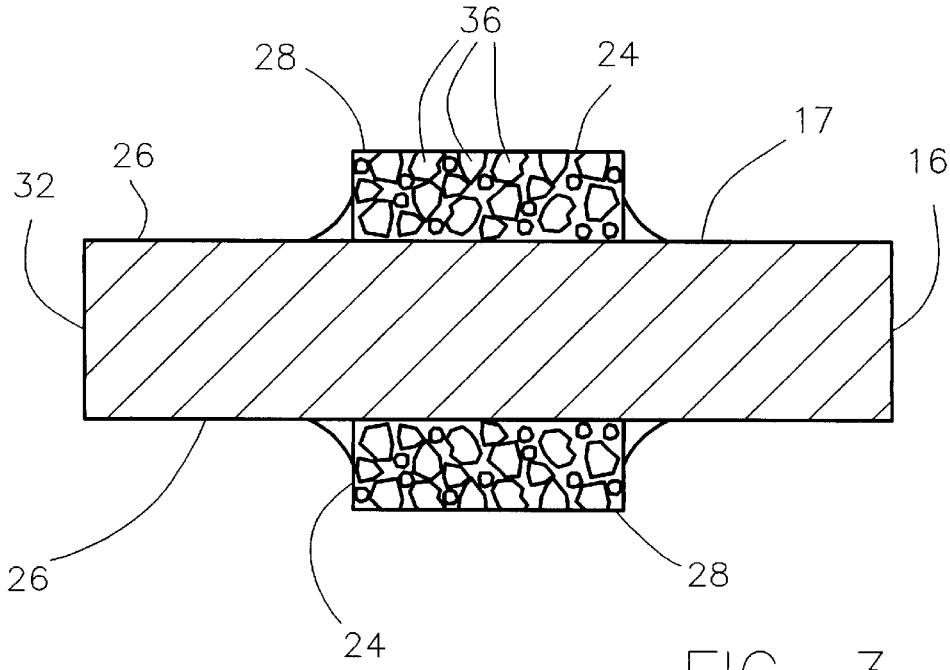
FIG. 3 PRIOR ART
FIG. 3 illustrates a section view of a dressing ring of FIG. 2 along lines 3—3.

Because the planetary disk polishing machines 10 are very expensive and because a very large number of glass disks must be polished in order to meet production requirements for high capacity magnetic disk drives, all reductions of non-productive down time for polishing pad dressing provide decided production and financial benefits by completing the pad dressing operations on the polishing pads 22 in a shorter period. The potential for cost reduction is a significant factor. The dressing disks 100 may be more inexpensively manufactured than the dressing rings 16 of the prior art. Further, the dressing disks 100 may be interchanged between various planetary polishing machines 10 by using the disk carriers 132 for any selected polishing machine with a set of dressing disks 100. The prior art dressing rings 16 of FIGS. 1, 2 and 3 must be custom fabricated for each specific polishing machine.

It should be understood that a person of ordinary skill in the art may make minor changes and alterations to the invention that will not remove the altered items from the scope of protection afforded by the attached claims which define the scope of protection of the invention.

We claim:

1. A process for dressing polishing pads used for polishing smooth surfaces comprising the steps of:

providing at least one polishing pad;

disposing at least one disk carrier comprising a plurality of openings therein for accepting dressing disks in juxtaposition with said polishing pad;

disposing within at least one of said plurality of openings at least one dressing disk within said disk carrier, said dressing disk being free to revolve relative to said disk carrier;

further disposing said at least one dressing disk in surface contact with said polishing pad, said at least one dressing disk having a surface comprising a matrix of a binder metal coating on said dressing disk and a concentration of diamond particles within and exposed through said binder metal coating;

flooding said polishing pad and said dressing disk with a fluid;

applying force to forcibly engage a face of said dressing disk with a face of said polishing pad;

driving said disk carrier in a motion to cause said disk carrier to move said dressing disk in an orbit around and in contact with said face of said polishing pad;

simultaneously with said foregoing moving step, rotating said dressing disk relative to said polishing pad, whereby said diamonds contained within and exposed through said binder metal coating engage said face of said polishing pad and relative motion therebetween causes a removal of a portion of said polishing pad, removing undesired material and exposing unused cerium particles bound with said polishing pad.

2. The process for dressing polishing pads of claim 1 wherein said diamonds within said binder metal are capable of passing through a mesh size of 180 and not passing through a mesh size of 220.

3. The process for dressing polishing pads of claim 1 wherein said binder metal matrix incorporating said diamonds covers substantially all of said surface of said dressing disk engaged with said polishing pad.

4. The process for dressing polishing pads of claim 2 wherein said binder metal matrix incorporating said diamonds covers substantially all of said surface of said dressing disk.

5. The process of claim 1 comprising an additional step of disposing a second polishing pad in juxtaposition with said at least one disk carrier and engaging said at least one dressing disk.

6. The process of claim 5 wherein said additional step is performed prior to said flooding step.

* * * * *